US006480094B1

(12) United States Patent
Chen et al.

(10) Patent No.: US 6,480,094 B1
(45) Date of Patent: Nov. 12, 2002

(54) SURFACE MOUNTABLE ELECTRICAL DEVICE

(75) Inventors: Jack Jih-Sang Chen, Taipei (TW); Chun-Ta Tseng, Taipei Hsien (TW); Chi-Hao Gu, Panchiao (TW)

(73) Assignee: Fuzetec Technology Co. Ltd., Hsin-Chuan (TW)

( * ) Notice: Subject to any disclaimer, the term of this patent is extended or adjusted under 35 U.S.C. 154(b) by 0 days.

(21) Appl. No.: 09/934,275

(22) Filed: Aug. 21, 2001

(51) Int. Cl.[7] ..... H01C 1/14
(52) U.S. Cl. ..... 338/328; 338/22 R; 338/309
(58) Field of Search ..... 338/328, 331, 338/332, 22 R, 313, 314, 325, 306, 254, 309

(56) References Cited

U.S. PATENT DOCUMENTS 5,493,266 A * 2/1996 Sasaki et al. ..... 338/22 R
5,688,424 A * 11/1997 Asida ..... 219/531
6,147,587 A * 11/2000 Hadano et al. ..... 338/21
6,157,289 A * 12/2000 Kojima et al. ..... 338/22 R
6,188,308 B1 * 2/2001 Kojima et al. ..... 338/22 R
6,242,997 B1 * 6/2001 Barrett et al. ..... 338/22 R
6,348,852 B1 * 2/2002 Kojima et al. ..... 338/22 R

* cited by examiner

*Primary Examiner*—Elvin Enad
*Assistant Examiner*—Kyung S. Lee
(74) *Attorney, Agent, or Firm*—Merchant & Gould P.C.

(57) ABSTRACT

A surface mountable electrical devices includes a laminate body having a plurality of stacked PTC sheets, two overlapping metal foil sheets sandwiched between two adjacent ones of the PTC sheets, a conductive first electrode layer, a conductive second electrode layer spaced apart from the first electrode layer, and a conductive third electrode layer. The two adjacent ones of the PTC sheets have contact faces with inlaid portions respectively inlaid with the metal foil sheets and non-inlaid portions bonded to each other. At least a conductive transverse layer interconnects the first and third electrode layers and the metal foil sheets.

4 Claims, 9 Drawing Sheets

SURFACE MOUNTABLE ELECTRICAL DEVICE

BACKGROUND OF THE INVENTION

1. Field of the Invention

This invention relates to a surface mountable electrical device, more particularly to a surface mountable electrical device that can serve as a circuit protection device, such as a fuse.

2. Description of the Related Art

FIG. 1 illustrates a conventional surface mountable electrical device (PTC thermistor) which includes a plurality of stacked PTC sheets 4 that have a positive thermal coefficient characteristic, a plurality of metal foil sheets 21, 23 alternately laminated with the PTC sheets 4, a first electrode layer 22 formed on an upper surface of the device, a second electrode layer 24 formed on a bottom surface of the device, a conductive first side layer 51 interconnecting the first electrode layer 22 and one of the metal foil sheets 23, and a conductive second side layer 52 interconnecting the second electrode layer 24 and another one of the metal foil sheets 21. Commercially available metal foil sheets, which are made from copper, normally have been surface treated at one side face so as to be attachable to a contacting surface of a PTC sheet. However, the other side face of each of the metal foil sheets is not surface treated and is relatively smooth. As a result, the non-surface-treated side face of each of the aforesaid metal foil sheets 21, 23 is in poor contact with the respective PTC sheet 4, and thus tends to peel from the respective PTC sheet 4.

In order to overcome the aforementioned drawback, U.S. Pat. No. 6,157,289 disclosed a surface mountable electrical device (see FIG. 2) that includes a metal foil sheet 11, which is sandwiched between two stacked PTC sheets 14 and that is surface treated by being plated with nickel layers 12 on opposite side faces thereof so as to roughen the side faces and so as to permit secure attachment of the same to contacting surfaces of the PTC sheets 14. However, the extra processing step of forming the nickel layers 12 significantly increases the cost of manufacture. Moreover, the metal foil sheet 11 is required to be formed with grooves along cutting lines by etching or die press prior to being laminated with the PTC sheets 14 for facilitating formation of pieces of the surface mountable electrical device in a subsequent cutting step.

SUMMARY OF THE INVENTION

Therefore, the object of the present invention is to provide a surface mountable electrical device that is capable of overcoming the aforementioned drawbacks.

According to the present invention, a surface mountable electrical device comprises: a laminate body having top and bottom faces and opposite first and second side faces transverse to and interconnecting the top and bottom faces, the laminate body including a plurality of stacked PTC sheets which have a positive thermal coefficient characteristic, two overlapping metal foil sheets sandwiched between each two adjacent ones of the PTC sheets and having contact ends that extend to and that are exposed from the first side face, a conductive first electrode layer formed on the top face, a conductive second electrode layer formed on the top face and spaced apart from the first electrode layer, and a conductive third electrode layer formed on the bottom face, the two adjacent ones of the PTC sheets having contact faces with inlaid portions respectively inlaid with the metal foil sheets, and non-inlaid portions bonded to each other; and at least a conductive transverse layer formed on the first side face and interconnecting the first and third electrode layers and the contact ends of the metal foil sheets.

BRIEF DESCRIPTION OF THE DRAWINGS

In drawings which illustrate embodiments of the invention.

DETAILED DESCRIPTION OF THE PREFERRED EMBODIMENTS

Figure 3:
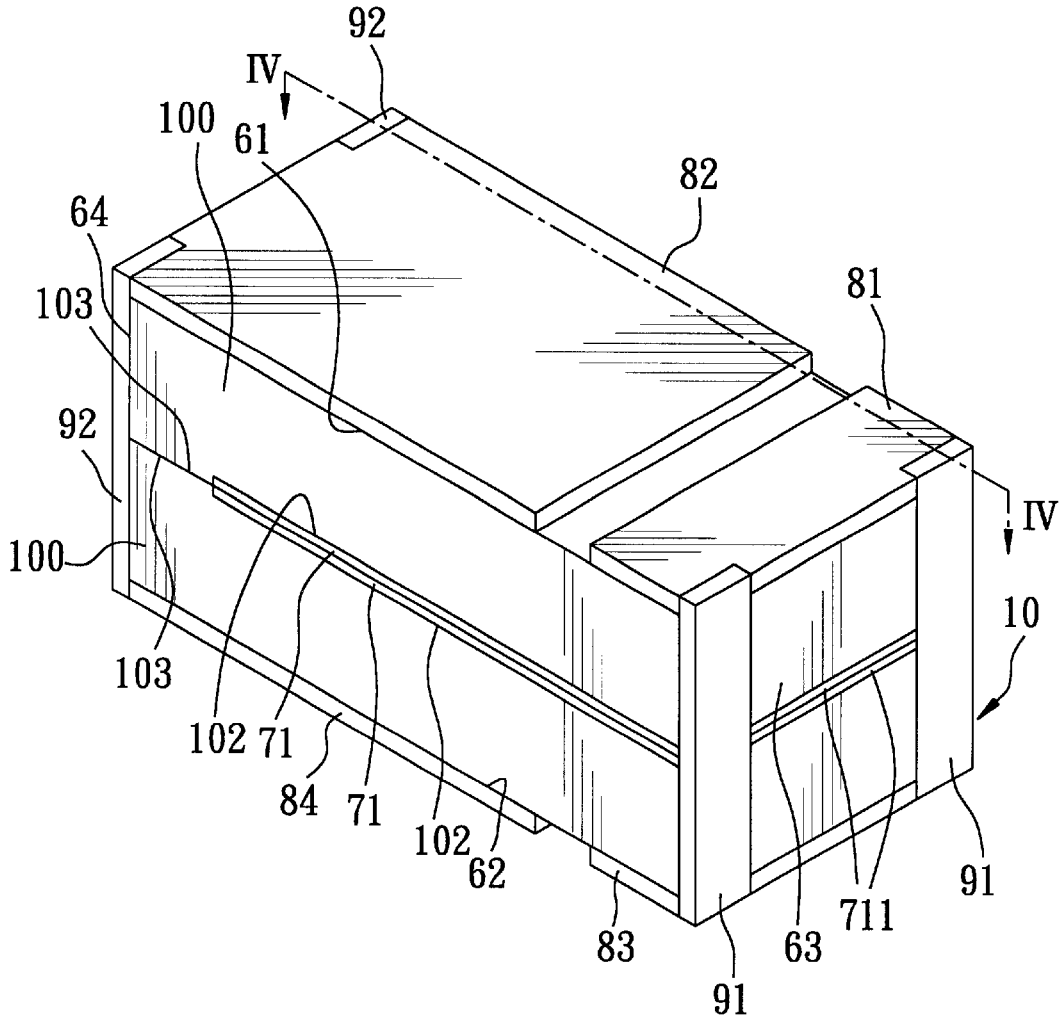
FIG. 3 is a perspective view of a first preferred embodiment of a surface mountable electrical device of this invention.
Figure 4:
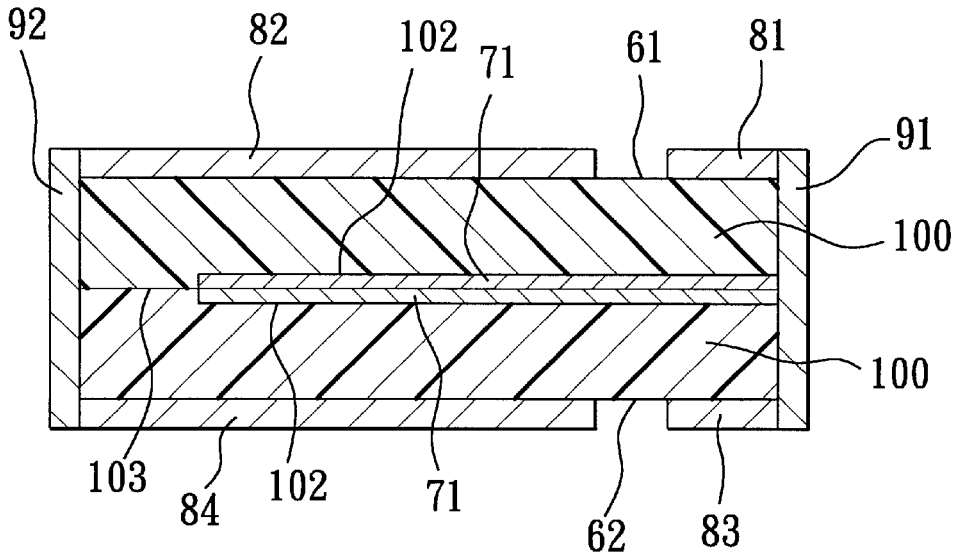
FIG. 4 is a sectional view of the first preferred embodiment, taken along line IV—IV in FIG. 3.

FIGS. 3 and 4 illustrate a first embodiment of a surface mountable electrical device of this invention. The surface mountable electrical device includes: a laminate body 10 having top and bottom faces 61, 62 and opposite first and second side faces 63, 64 transverse to and interconnecting the top and bottom faces 61, 62, the laminate body 10 including a plurality of stacked PTC sheets 100 which have a positive thermal coefficient characteristic, two overlapping first metal foil sheets 71 sandwiched between each two adjacent ones of the PTC sheets 100 and having contact ends 711 that extend to and that are exposed from the first side face 63, a conductive first electrode layer 81 formed on the top face 61, a conductive second electrode layer 82 formed on the top face 61 and spaced apart from the first electrode layer 81, and a conductive third electrode layer 83 formed on the bottom face 62; and two conductive first transverse layers 91 formed on the first side face 63 and interconnecting the first and third electrode layers 81, 83 and the contact ends 711 of the first metal foil sheets 71. Each two adjacent ones of the PTC sheets 100 have contact faces with first inlaid portions 102 respectively inlaid with the first metal foil sheets 71, and non-inlaid portions 103 bonded to each other. The laminate body 10 is formed by thermally pressing the PTC sheets 100, the first metal foil sheets 71, and the first, second and third electrode layers 81, 82, 83 so as to permit the PTC sheets 100 to be inlaid with the first metal foil sheets 71 and the non-inlaid portions 103 of the contact faces of the PTC sheets 100 to be bonded together. The first transverse layers 91 can be formed by conventional plating techniques.

The laminate body 1 can further include a conductive fourth electrode layer 84 that is formed on the bottom face 62 and that is spaced apart from the third electrode layer 83. Two conductive second transverse layers 92 are formed on the second, side face 64, interconnect the second and fourth electrode layers 82, 84, and are spaced apart from the first metal foil sheets 71 by the non-inlaid portions 103 of the contact faces of the PTC sheets 100.

Figure 5:
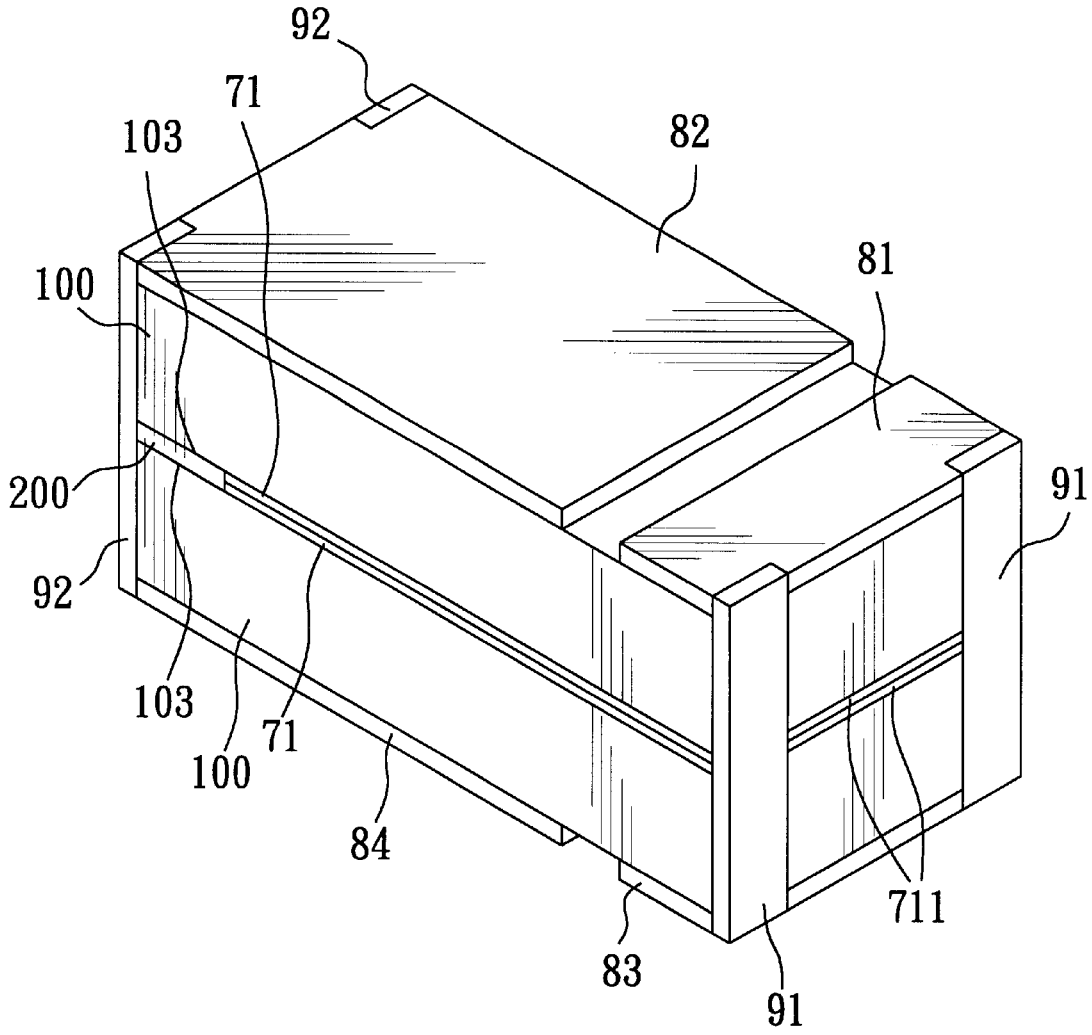
FIG. 5 is a perspective view of a second preferred embodiment of a surface mountable electrical device of this invention.

FIG. 5 illustrates a second embodiment of the surface mountable electrical device of this invention, which has a configuration similar to that of the previous embodiment shown in FIG. 3, except that an adhesive layer 200 is coated on the non-inlaid portions 103 of the contact faces of each two adjacent ones of the PTC sheets 100 so as to enhance the bonding strength therebetween.

Figure 6:
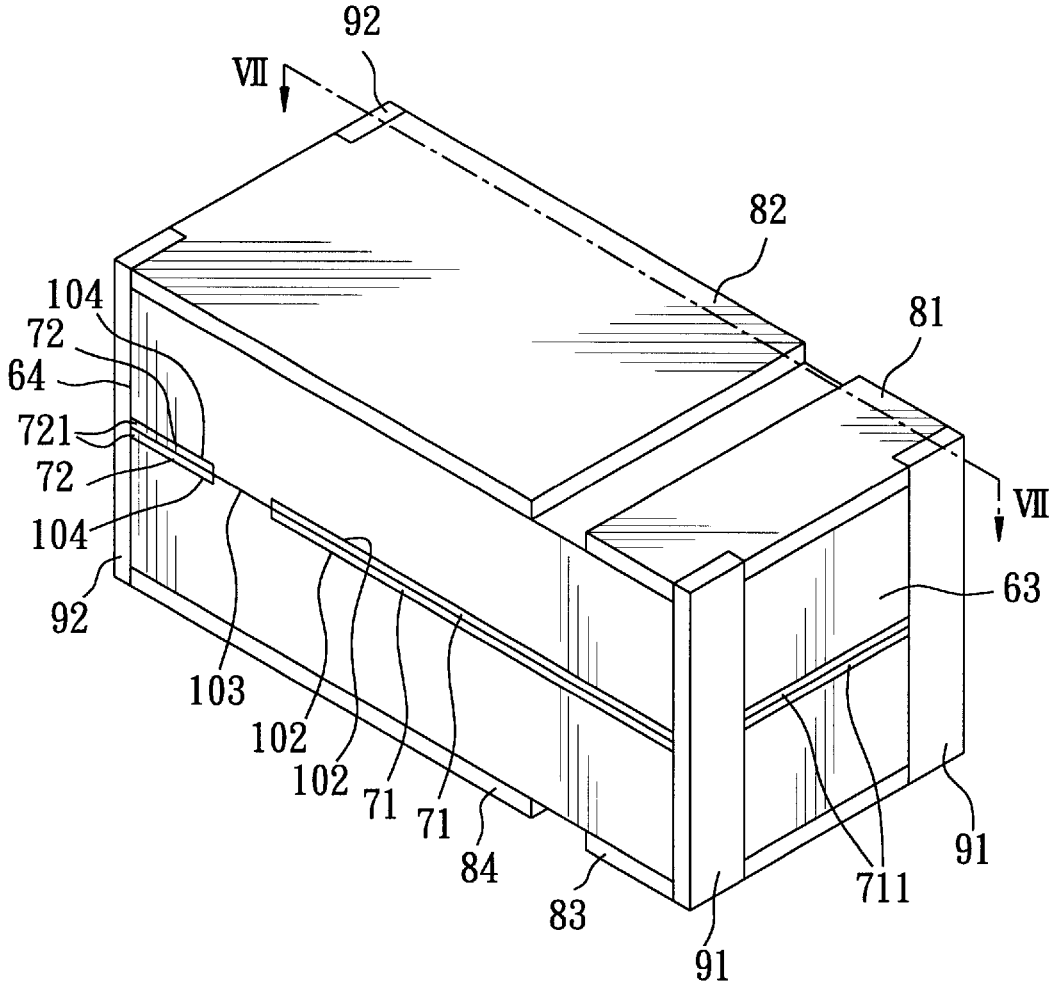
FIG. 6 is a perspective view of a third preferred embodiment of a surface mountable electrical device of this invention.
Figure 7:
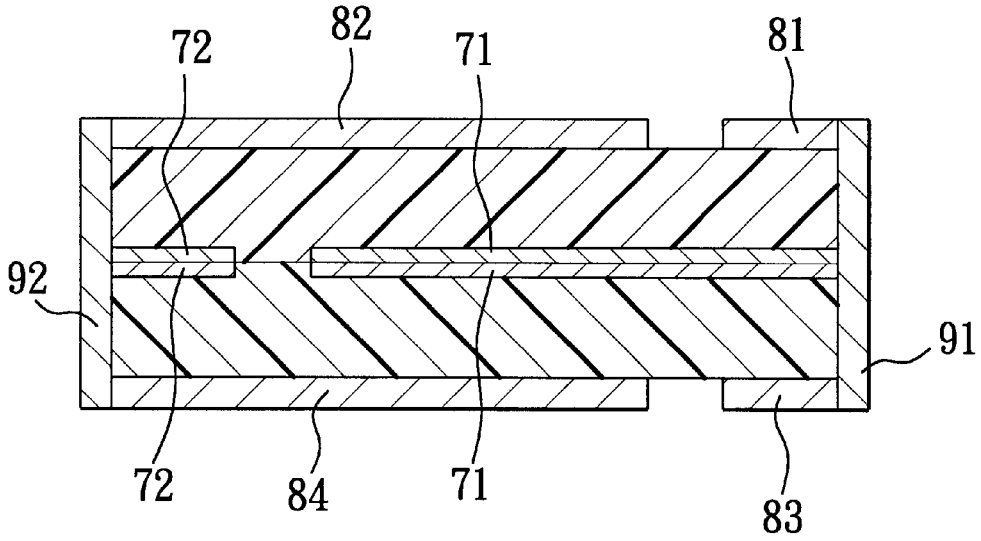
FIG. 7 is a sectional view of the third preferred embodiment, taken along line VII—VII in FIG. 6.

FIGS. 6 and 7 illustrate a third embodiment of the surface mountable electrical device of this invention, which has a configuration similar to that of the previous embodiment shown in FIG. 3, except that two overlapping second metal foil sheets 72 are sandwiched between each two adjacent ones of the PTC sheets 100 and have contact ends 721 that extend to and that are exposed from the second side face 64 so as to be connected to the second transverse layers 92. The contact faces of each two adjacent ones of the PTC sheets 100 further have second inlaid portions 104 that are respectively inlaid with the second metal foil sheets 72. The first and second metal foil sheets 71, 72 are spaced apart by the non-inlaid portions 103 of the contact faces of the PTC sheets 100.

Figure 1:
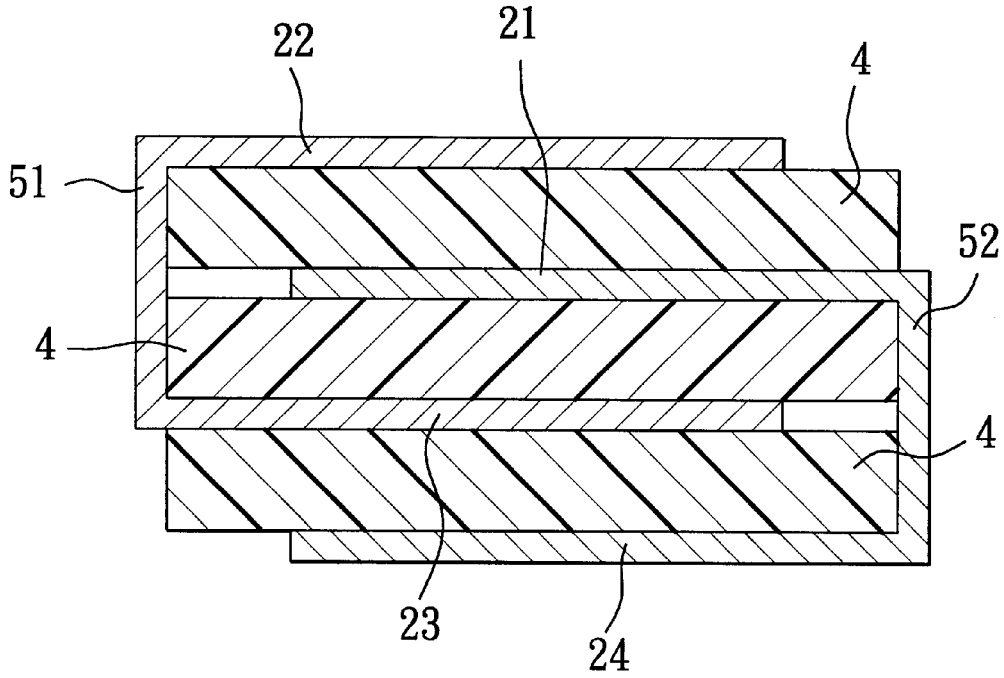
FIG. 1 PRIOR ART
FIG. 1 is a cross-sectional view of a conventional surface mountable electrical device.
Figure 2:
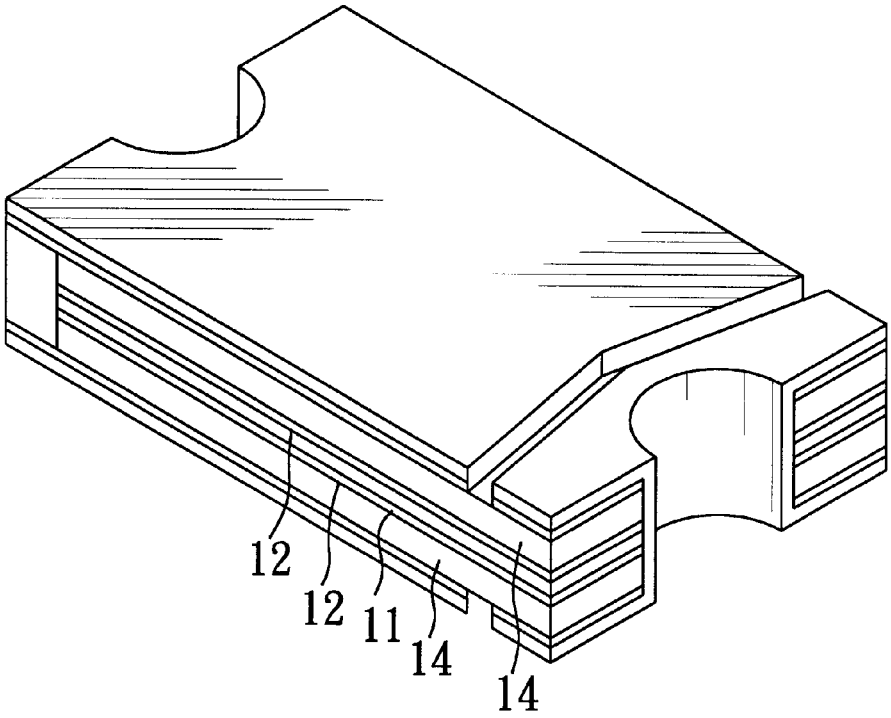
FIG. 2 PRIOR ART
FIG. 2 is a perspective partly sectioned view of another conventional surface mountable electrical device.

The first and second metal foil sheets 71, 72 are commercially available, and each of which has one side face that is surface treated and that is attached securely to the inlaid portion 102 of the contact face of a respective one of the PTC sheets 100, and an opposite side face that is not surface treated and that is in contact with an adjacent one of the first and second metal foil sheets 71, 72. Because they are made of the same material, the two overlapping first or second metal foil sheets 71, 72 are in better surface contact as compared to that between the PTC sheet and the metal foil utilized in the prior art (see FIG. 1). Moreover, because of the non-inlaid portions 103 of the contact faces of the PTC sheets 100, each two adjacent ones of the PTC sheets 100 can be bonded together via thermal-pressing techniques, thereby eliminating the drawbacks as encountered in the prior art (see FIGS. 1 and 2).

Figure 8:
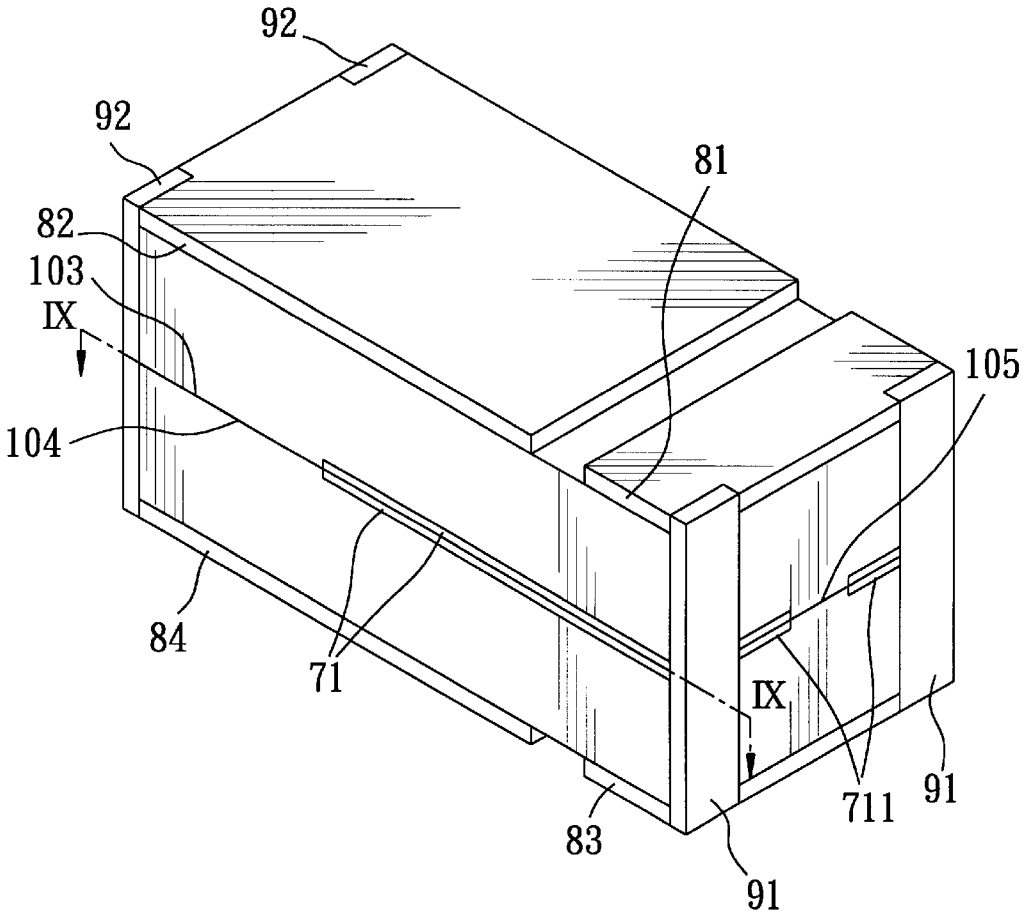
FIG. 8 is a perspective view of a fourth preferred embodiment of a surface mountable electrical device of this invention.
Figure 9:
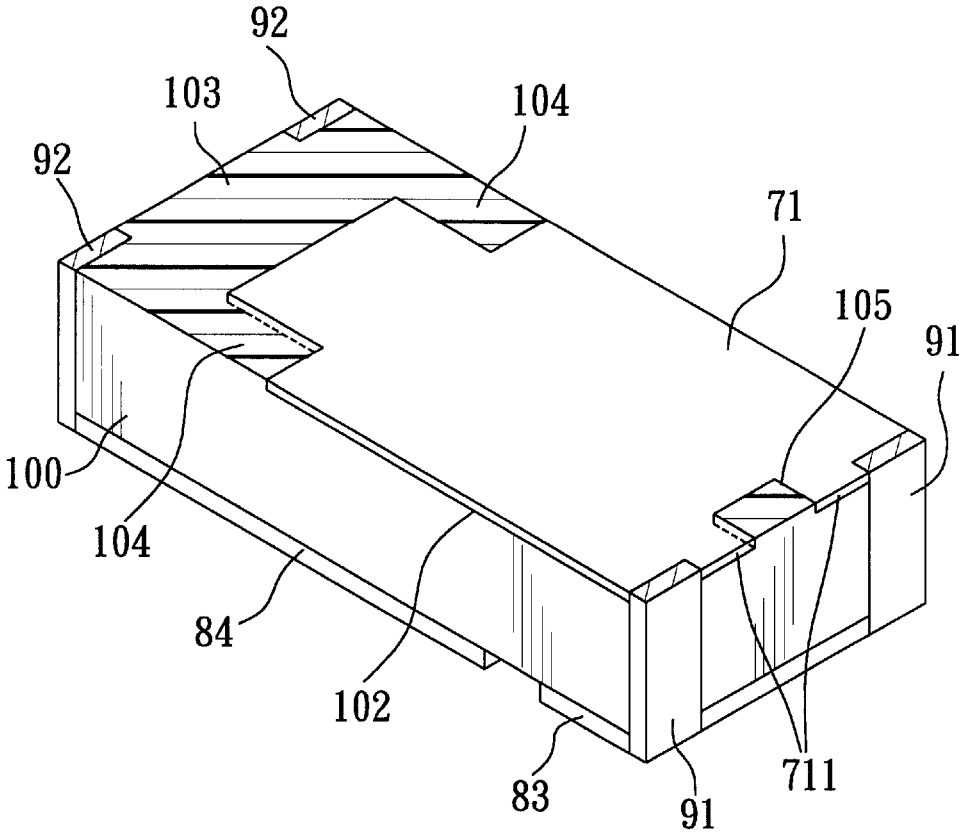
FIG. 9 is a sectional view of the fourth preferred embodiment, taken along line VII—VII in FIG. 6.

The bonding strength between each two adjacent ones of the PTC sheets 100 is dependent on the contacting area therebetween. FIGS. 8 and 9 illustrate a fourth embodiment of the surface mountable electrical device of this invention, which has a configuration similar to that of the first embodiment shown in FIG. 3, except that the contact face of each PTC sheet 100 further has additional non-inlaid portions 104, 105 so as to increase the contacting area between each two adjacent ones of the PTC sheets 100 and so as to enhance the bonding strength therebetween.

With the invention thus explained, it is apparent that various modifications and variations can be made without departing from the spirit of the present invention. It is therefore intended that the invention be limited only as recited in the appended claims.

We claim:

1. A surface mountable electrical device, comprising:

a laminate body having top and bottom faces and opposite first and second side faces transverse to and interconnecting said top and bottom faces, said laminate body including a plurality of stacked PTC sheets which have a positive thermal coefficient characteristic, and a metal foil component sandwiched between each two adjacent ones of said PTC sheets and consisting of two overlapping first metal foil sheets of the same metal, each of said first metal foil sheets having one side face that is surface treated and that is attached securely to a respective one of said PTC sheets, and an opposite side face that is not surface treated and that is in face-to-face contact with the other one of said first metal foil sheets, said first metal foil sheets having contact ends that extend to and that are exposed from said first side face, said laminate body further including a conductive first electrode layer formed on said top face, a conductive second electrode layer formed on said top face and spaced apart from said first electrode layer, and a conductive third electrode layer formed on said bottom face, said two adjacent ones of said PTC sheets having contact faces that have first inlaid portions respectively inlaid with said first metal foil sheets, and that further have non-inlaid portions bonded to each other; and at least a conductive first transverse layer formed on said first side face and interconnecting said first and third electrode layers and said contact ends of said first metal foil sheets.

2. The surface mountable electrical device of claim 1, wherein said laminate body further includes a conductive fourth electrode layer formed on said bottom face and spaced apart from said third electrode layer, said surface mountable electrical device further comprising at least a conductive second transverse layer formed on said second side face, interconnecting said second and fourth electrode layers, and spaced apart from said first metal foil sheets by said non-inlaid portions of said contact faces.

3. The surface mountable electrical device of claim 1, wherein said laminate body further includes a conductive fourth electrode layer formed on said bottom face and spaced apart from said third electrode layer, said surface mountable electrical device further comprising at least a conductive second transverse layer formed on said second side face and interconnecting said second and fourth electrode layers, said laminate body further having two overlapping second metal foil sheets sandwiched between two adjacent ones of said PTC sheets and having contact ends that extend to and that are exposed from said second side face and that are connected to said second transverse layer, said contact faces of said two adjacent ones of said PTC sheets further having second inlaid portions respectively inlaid with said second metal foil sheets, said first and second metal foil sheets being spaced apart by said non-inlaid portions of said contact faces.

4. The surface mountable electrical device of claim 1, further comprising an adhesive layer coated on said non-inlaid portions of said contact faces of said two adjacent ones of said PTC sheets.

* * * * *